United States Patent [19]

Roth

[11] Patent Number: 4,842,572

[45] Date of Patent: Jun. 27, 1989

[54] APPARATUS FOR SUBDIVIDING A RUNNING WEB OF PANELS IN ZIG-ZAG FORMATION INTO STACKS

[75] Inventor: Oscar Roth, Zufikon, Switzerland

[73] Assignee: Involvo AG, Bünzen, Switzerland

[21] Appl. No.: 181,555

[22] Filed: Apr. 14, 1988

[30] Foreign Application Priority Data

Apr. 16, 1987 [CH] Switzerland ..... 01495/87
Oct. 2, 1987 [CH] Switzerland ..... 03867/87

[51] Int. Cl.[4] ..... B65H 35/06

[52] U.S. Cl. ..... 493/357; 225/104; 270/39; 270/52.5; 493/410

[58] Field of Search ..... 493/357, 358, 359, 360, 493/412; 270/30, 39, 52.5; 225/93, 104; 83/169

[56] References Cited

U.S. PATENT DOCUMENTS

| | | | |
|---|---|---|---|
| 3,640,521 | 2/1972 | Hutley | 493/412 |
| 4,650,447 | 3/1987 | Meschi | 493/412 |
| 4,673,382 | 6/1987 | Buck et al. | 493/359 |
| 4,708,332 | 11/1987 | Besemann | 270/39 |

*Primary Examiner*—Frederick R. Schmidt

*Assistant Examiner*—Jack Lavinder

*Attorney, Agent, or Firm*—Peter K. Kontler

[57] ABSTRACT

A continuous running web with panels in zig-zag formation is delivered by a conveyor in the form of a scalloped stream and successive panels are deflected into a duct wherein the panels descend and gather on a bottom wall between two upright sidewalls which contact alternate fold lines between the panels of the growing stack. When the stack on the bottom wall, which descends at the rate at which the stack thereon grows, contains a predetermined number of panels, a spreading device is caused to enter between the topmost panel of the fully grown stack on the bottom wall and the panel above such stack to establish a gap for entry of the dull leading edge of a reciprocable flat tool which moves across the duct in a horizontal plane and breaks the fold line which is then located in the path of movement of the leading edge. The sidewalls have confronting vertical surfaces which are inclined relative to the leading edge of the tool. Such leading edge can be formed by a small-diameter roller which is mounted on a plate-like portion of the tool and is driven so that it rolls along the panel above it while the tool moves across the duct.

14 Claims, 6 Drawing Sheets

APPARATUS FOR SUBDIVIDING A RUNNING WEB OF PANELS IN ZIG-ZAG FORMATION INTO STACKS

BACKGROUND OF THE INVENTION

The invention relates to improvements in apparatus for manipulating continuous webs of panels or sheets (hereinafter called panels) which are made of paper or other foldable material. More particularly, the invention relates to improvements in apparatus for subdividing a continuous running web of panels in zig-zag formation subsequent to accumulation of panels into piles or stacks.

It is customary to arrange freshly imprinted panels, which issue from a machine for imprinting information (e.g., of the type to be found on forms) on a continuous web of paper or the like and which together form a continuous web of panels, in zig-zag formation with fold lines between them and to gather the advancing panels into a succession of piles or stacks each of which contains a predetermined number of panels. A fully grown pile must be separated from the next-following panel, i.e., from the foremost panel of the remainder of the running web. As a rule, the last panel of a fully assembled pile or stack, or the foremost panel of the web behind a fully grown stack, is provided with a colored indicium which is applied by a suitable marking tool in the form of a pencil or pen receiving impulses from the printing machine at intervals which are required to gather a predetermined number of panels, e.g., a ream of 500 panels. Each fully grown stack is manually separated from the next-following panel of the web at the locus of the respective colored indicium. This is a time-consuming operation and, therefore, the severing or separating station constitutes a bottleneck which prevents the printing machine from operating at full speed and which also necessitates a relatively slow operation of the next-following machine, such as a machine wherein successive reams of stacked panels are confined in boxes, in sheets of wrapping material or the like. Losses in output are especially high if the printing machine is a multi-row machine.

OBJECTS AND SUMMARY OF THE INVENTION

An object of the invention is to provide an apparatus which can automatically separate successive fully grown stacks from a continuous web of panels advancing in zig-zag formation, for example, from the outlet of a high-speed form printing machine.

Another object of the invention is to provide the apparatus with novel and improved means for severing the web at required intervals without necessitating even temporary slowing down of the printing machine.

A further object of the invention is to provide the apparatus with novel and improved means for accumulating the foremost panels of a continuous running web into a succession of stacks.

An additional object of the invention is to provide the apparatus with novel and improved means for facilitating penetration of severing means between selected panels of the web.

Still another object of the invention is to provide novel and improved means for supporting successive growing stacks and for rapidly and reliably removing each fully grown and separated stack from the stack forming and separating station or stations.

A further object of the invention is to provide the apparatus with novel and improved means for guiding successive panels of a running web on their way toward and in the stack growing station.

Another object of the invention is to provide a novel and improved method of rapidly and predictably converting a continuous running web of panels in zig-zag formation into a succession of discrete stacks at the rate at which the panels issue from a high-speed printing or other machine while the machine is operated at full speed.

A further object of the invention is to provide a novel and improved method of opening up an accumulation of superimposed panels at the desired locus of separation of a fully grown stack from the next-following panel of the running web.

The invention is embodied in an apparatus for subdividing a continuous web of mutually inclined panels in zig-zag formation wherein neighboring panels are connected to each other by fold lines. The apparatus comprises a substantially upright duct including two spaced-apart sidewalls having confronting substantially vertical surfaces and a bottom wall, conveyor means for advancing the web longitudinally in a predetermined direction toward the duct while the neighboring panels of the advancing web at least partially overlap each other, a set of rotary discs or other suitable deflecting means for directing successive panels of the advancing web into the duct from above so that the foremost panel of the web comes to rest on the bottom wall and successive fold lines abut the surfaces of different sidewalls of the duct whereby the duct accumulates a growing stack of overlapping panels, and means for severing or breaking a fold line between two neighboring panels in the duct adjacent one of the vertical surfaces at a predetermined level between the directing means and the bottom wall. The severing means includes a flat severing tool having a dull leading edge which is inclined with reference to the surfaces of the sidewalls, and means (such as a double-acting pneumatic cylinder and piston unit) for moving the tool between a retracted position in which the tool is outside the duct and its leading edge is outwardly adjacent the other vertical surface, along a substantially horizontal path extending across the duct at the predetermined level so that the leading edge breaks the fold line at the predetermined level to thereby separate the stack between the bottom wall and the predetermined level from the panel above such level, and an extended position in which the leading edge is outwardly adjacent (at least in part) the one surface.

The apparatus can further comprise means for spreading apart the two neighboring panels in the duct, namely the panels which are connected to each other by the fold line at the predetermined level, so that the two neighboring panels define a gap between the top of a fully grown stack resting on the bottom wall of the duct and the remaining portion of the advancing web. Such apparatus preferably further comprises means for moving the spreading means at the predetermined level ahead of the leading edge, preferably shortly before the leading edge of the severing tool begins to move from the retracted position toward the extended position.

The sidewall which has the one surface can be provided with a slit-shaped passage for the leading edge of the severing tool.

The bottom wall of the duct can have a substantially convex panel-supporting top face with an apex extending substantially transversely of the direction of advancement of the web toward the directing means. The bottom wall can be deformable or adjustable so as to permit alterations of the shape and/or position of the top face.

At least one of the sidewalls can comprise an endless band having a substantially vertical stretch which is provided with the respective substantially vertical surface, and means for driving the belt so that its stretch advances toward the bottom wall of the duct. The apparatus can also comprise means for movably supporting at least one of the sidewalls so that the one sidewall can be moved toward or away from the other sidewall to thereby vary the distance between the substantially vertical surfaces.

The apparatus can also comprise elevator means for moving the bottom wall of the duct upwardly toward but short of the predetermined level (preferably to an uppermost position close to the predetermined level) and downwardly to a second level, and second conveyor means serving to accept a freshly separated stack from the bottom wall while the bottom wall descends toward the second level.

The tool can comprise a substantially roller-shaped rotary element which defines the leading edge. Such apparatus can further comprise means for rotating the rotary element during movement of the tool along its path so that the rotary element rolls along the underside of the panel above the predetermined level regardless of whether the tool moves from the retracted toward the extended position or vice versa. The severing means can further comprise means for reducing friction between the upper side and/or the underside of the tool and the adjacent panel in the duct while the tool moves between its positions. The tool is or can be arranged to move along its path in a direction making an acute angle with the direction of advancement of the web toward the duct.

The spreading means can comprise a plurality of relatively movable components and means for moving at least one of these components relative to another component so as to establish the aforementioned gap by moving the panel above the predetermined level away from the panel beneath such level and/or vice versa.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
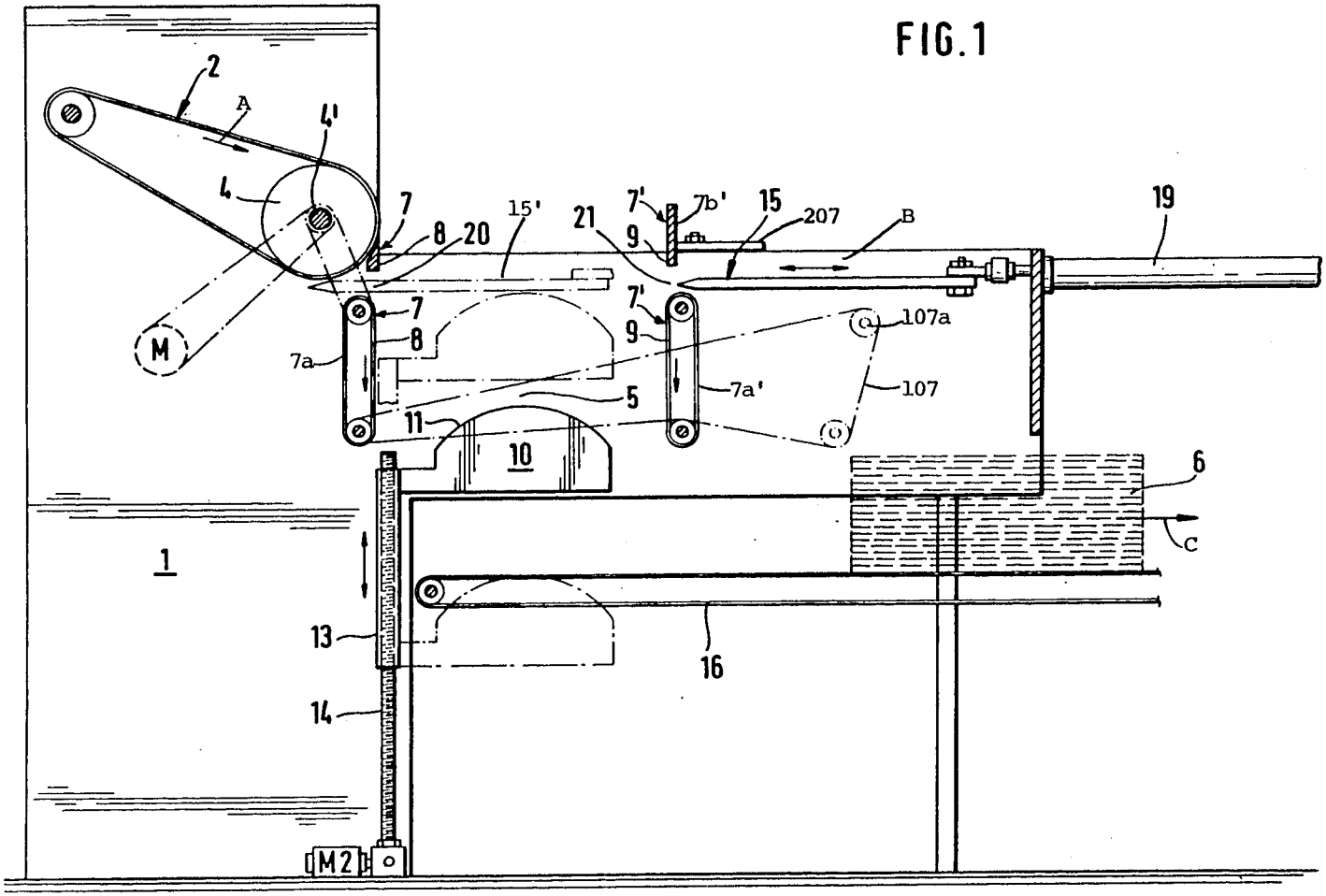
FIG. 1 is a schematic partly elevational and partly vertical sectional view of certain parts of an apparatus wich embodies one form of the invention, the retracted and extended positions of the severing tool being respectively shown by solid lines and by phantom lines.
Figure 2:
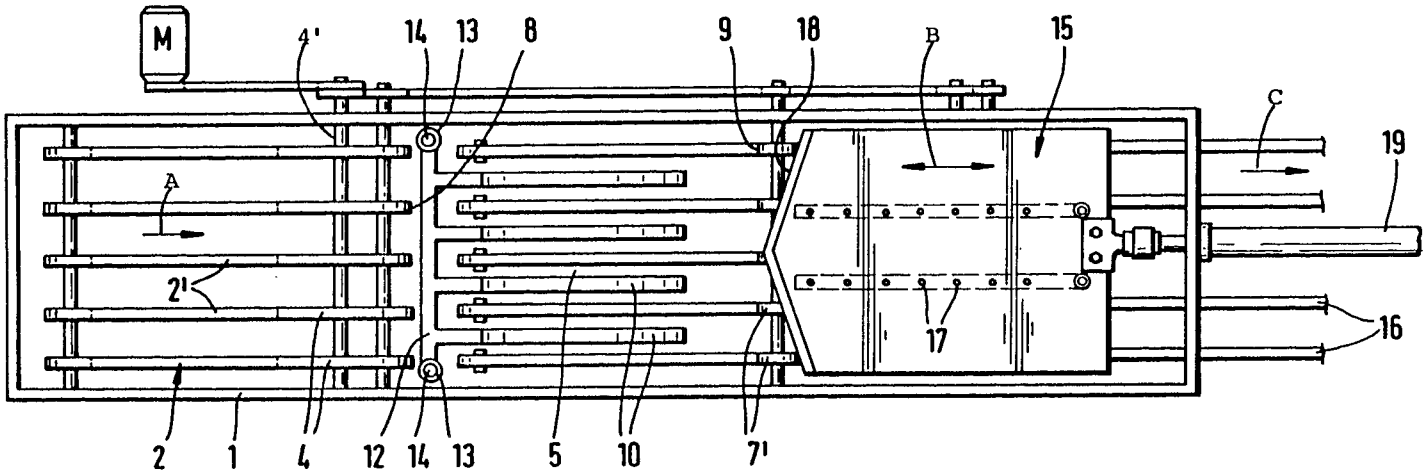
FIG. 2 is a plan view of the apparatus of FIG. 1.
Figure 3:
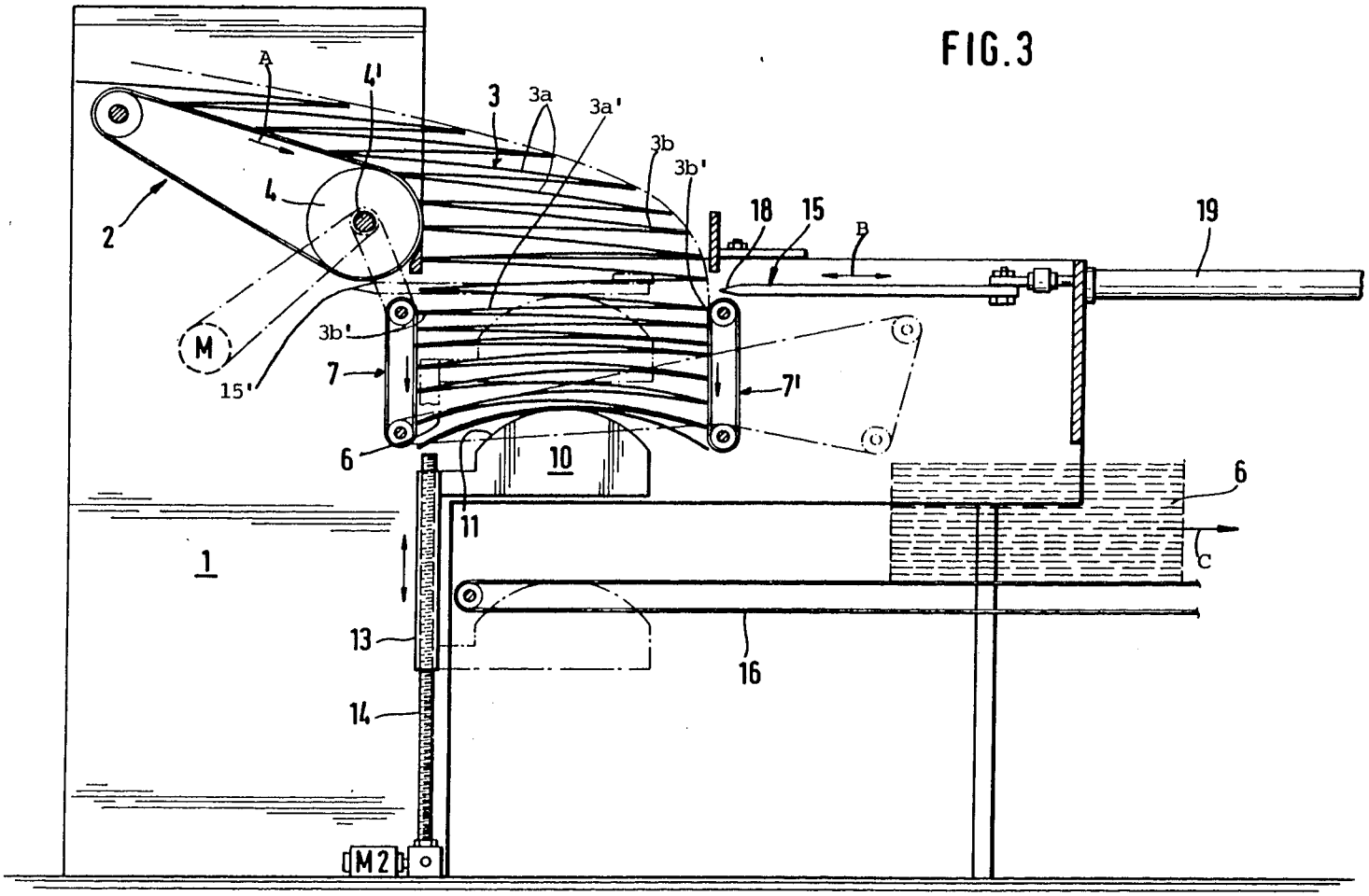
FIG. 3 is a view similar to that of FIG. 1 and further showing a web in the process of advancing toward and into the duct so that the lowermost panel of the web rests on the bottom wall of the duct.

Referring first to FIGS. 1 to 3, there is shown an apparatus which comprises a frame or housing 1 supporting an endless belt conveyor 2 which serves to advance a continuous web 3 of panels 3*a*. The panels 3*a* are in zig-zag formation and are connected to each other by fold lines 3*b*. The web 3 is assumed to issue from the outlet of a form printing machine and its panels 3*a* are to be gathered into a succession of stacks 6 (e.g., each such stack can comprises 500 superimposed panels 3) which are delivered to a wrapping or packing machine, not shown, by a second endless belt conveyor 16. The conveyor 2 advances the web 3 toward the upper end of an upright duct 5 while the panels 3*a* partially overlie each other so that they can be said to form a so-called scalloped stream.

The discharge end of the conveyor 2 is adjacent a deflecting or directing device which serves to direct successive panels 3*a* of the advancing web 3 into the duct 5 and includes a driven horizontal shaft 4' for a set of coaxial discs or wheels 4. The conveyor 2 comprises a plurality of relatively narrow endless bands 2' each of which is trained over a disc 4 of the diverting device. The shaft 4' is driven by a suitable motor M which is common to the conveyor 2 and the directing device 4, 4'.

The duct 5 comprises two spaced-apart upright sidewalls 7 and 7' which are or can be mirror images of each other and are supported by the frame 1, the same as the conveyor 2 and the directing device 4, 4'. The duct 5 preferably further comprises two additional vertical sidewalls (not shown) which alternate with the sidewalls 7, 7' so as to bound the front and rear sides of the space within the duct 5, as seen in FIG. 1 or 3. Still further, the duct 5 comprises a preferably deformable or adjustable bottom wall 10 having a convex panel-supporting top face 11 with an apex extending at right angles to the direction (arrow A) of advancement of the web 3 toward the upper end of the duct 5. The bottom wall 10 is assembled of several parallel vertical plate-like members (see FIG. 2) which are connected to each other by a horizontal web 12 extending transversely of the direction which is indicated by the arrow A and having end portions connected to or integral with internally threaded sleeves 13 forming part of an elevator which serves to move the bottom wall 10 up and down at a rate preferably corresponding to the rate at which the top face 11 of the bottom wall 10 accumulates a growing stack 6, i.e., at the rate at which the device 4, 4' directs successive panels 3*a* of the web 3 into the space between the sidewalls 7, 7' of the duct 5. The sidewalls 7, 7' have confronting substantially vertical surfaces 8, 9 which contact alternate fold lines 3*b* in the duct 5 and ensure that the panels 3*a* of the growing stack 6 on the top face 11 accurately overlap each other.

The lower portions of the sidewalls 7, 7' respectively include endless belts 7*a*, 7*a'* having vertical stretches which are provided with the respective portions of the surfaces 8, 9 and are caused to move downwardly, i.e., toward the bottom wall 10, when the apparatus is in use. The means for driving the belts *7a*, *7a'* includes one or more endless belts 107 which are trained over suitable pulleys 107*a* and receive motion from the motor M or from a separate motor. The belt or belts 107 frictionally engage the lower pulley for the belt *7a'* and are trained over the lower pulley for the belt *7a*. The surfaces 8, 9 are in slight frictional engagement with the adjacent fold lines *3b* to urge the panels *3a* in the duct downwardly toward the bottom wall 10 so as to ensure that the height of the growing stack 6 on the top face 11 of the bottom wall 10 increases at a rate which is proportional to the rate of admission of panels *3a* into the duct 5.

The reference character 207 denotes in FIG. 1 a device which movably secures the plate-like upper portion *7b'* and the pulleys for the belt *7a'* of the sidewall 7' to the frame 1 and thus renders it possible to move the sidewall 7' toward or away from the sidewall 7 so as to reduce or increase the distance between the surfaces 8 and 9. This enables an attendant to convert the apparatus for the gathering of stacks which are assembled of smaller or larger panels. It is clear that the apparatus can also comprise means for movably supporting the sidewall 7 (such supporting means can be provided in addition to or in lieu of the supporting means 207), as well as that the apparatus can comprise means for movably supporting at least one of the aforementioned (non-illustrated) sidewalls which alternate with the sidewalls 7 and 7'.

Each of the endless belts *7a*, *7a'* can comprise a set of parallel narrow endless bands with clearances between neighboring bands for suitable agitating elements (not shown) in the form of pushers or the like which are driven by one or more eccentrics so as to promote the descent of panels *3a* in the duct 5 as well as to facilitate the formation of a growing stack 6 wherein the superimposed panels *3a* accurately overlap each other. Alternatively, or in addition to such agitating elements, at least one of the four sidewalls of the duct 5 can be vibrated or otherwise agitated to further ensure a highly predictable downward movement of panels *3a* in the duct and the gathering of panels into stacks which consist of accurately overlapping panels.

As mentioned above, the bottom wall 10 of the duct 5 has a convex top face 11 which has an apex extending at right angles to the direction which is indicated by the arrow A, i.e., such apex is parallel to the surfaces 8, 9 of the sidewalls 7, 7', respectively. The convex top face 11 contacts the median portion of the underside of the lowermost or foremost panel *3a* of the web 3 and ensures that the median portions of certain panels *3a* in the duct 5 are located at or at least close to the level of the fold lines *3b* which connect such panels to the neighboring panels *3a* in the duct. In other words, and referring to the panel *3a'* in FIG. 3, the median portion of this panel is located at or very close to the levels of the two fold lines marked *3b'* (one of the fold lines *3b'* is adjacent the surface 8 and the other of these fold lines is adjacent the surface 9). It will be seen that the convex top face 11 ensures that the panels *3a* which are adjacent the upper ends of the inner reaches or stretches of the endless belts *7a*, *7a'* of the sidewalls 7, 7' are at least substantially horizontal.

The aforementioned internally threaded sleeves 13 of the elevator means for the bottom wall 10 mate with vertical feed screws 14 which are rotatable by a reversible electric motor M2 or another suitable prime mover. The motor M2 can move the bottom wall 10 upwardly toward and preferably close to a horizontal plane for the plate-like portion of a flat severing tool 15 which is reciprocable in directions indicated by a double-headed arrow B by a moving means including a double-acting pneumatic cylinder and piston unit 19. When the bottom wall 10 is moved to its lower end position, the apex of its top face 11 is located at least slightly beneath the upper reach of the second conveyor 16 so that the upper reach of the conveyor 16 automatically accepts a fully grown stack 6 from the bottom wall 10 and is ready to advance such stack in the direction of arrow C, e.g., to a wrapping or packing machine, not shown. The upper and lower end positions of the bottom wall 10 are shown in FIGS. 1 and 3 by phantom lines. It will be seen that the conveyor 16 comprises several parallel narrow bands which are disposed in vertical planes and alternate with the plate-like members of the bottom wall 10 so that the latter can move across the conveyor 16 on its way to or from the lower end position.

The severing tool 15 has a dull arrowhead-shaped leading edge 18 which is inclined relative to the vertical surfaces 8, 9 of the sidewalls 7 and 7'. This can be readily seen in FIG. 2. The tool 15 is preferably hollow and defines a plenum chamber which receives compressed air from a suitable source (not shown), e.g., by way of the piston rod of the cylinder and piston unit 19. Jets or streamlets of compressed air can escape through suitably distributed orifices 17 which are provided in the upper side of the tool 15 to reduce friction with the adjacent panel *3a* (above the level of the tool 15) when the tool is caused to move from the retracted position (shown in FIGS. 1–3 by solid lines) to the extended position 15'. The path of movement of the tool 15 between the retracted and extended positions is a horizontal path. The entire tool 15 is located outside the duct 5 when it assumes the retracted position, and the leading edge 18 is then outwardly adjacent the surface 9. When the tool 15 reaches the extended position 15', at least a portion of the leading edge 18 is outwardly adjacent the surface 8. This ensures that the leading edge 18 breaks the fold line *3b* (each fold line can be formed with a row of perforations to facilitate separation of neighboring panels *3a* from one another) which is then located in the plane of the tool 15, namely, at a predetermined level between the directing device 4, 4' and the convex top face 11 of the vertically movable bottom wall 10. The orifices 17 can be provided in addition to or in lieu of other suitable friction reducing means, e.g., rounded protuberances provided at the upper side and/or at the underside of the tool 15 in order to ensure that the tool 15 will not unduly shift or even deform the adjacent panel or panels *3a* during movement from the retracted position, through a slit-shaped passage 21 above the belt *7a'*, across the space which is bounded by the sidewalls of the duct 5, and through a slit-shaped passage 20 in the sidewall 7, i.e., in that sidewall which has the vertical surface 8. The latter abuts that fold line *3b* which is destroyed in response to movement of the tool 15 to its extended position 15'.

The operation of the apparatus of FIGS. 1 to 3 is as follows:

When the conveyor is about to advance the foremost panel *3a* of the running web 3 toward the directing device 4, 4', the bottom wall 10 of the duct 5 is held in the upper end position close to but still below the level of the tool 15, and the tool is held in the retracted position in which the leading edge 18 is outwardly adjacent the surface 9. The conveyor 2 delivers successive panels 3*a* of the web 3 into the range of the directing device 4, 4′ whose discs 4 direct the panels 3*a* into the open upper end of the duct 5 wherein the panels descend toward and the lowermost panel comes to rest on the top face 11 of the bottom wall 10. The elevator including the motor M2 then begins to lower the bottom wall 10 at a rate which is proportional to the rate of introduction of panels 3*a* into the duct 5, and the bottom wall 10 supports a continuously growing and continuously descending stack 6. The surfaces 8, 9 of the sidewalls 7, 7′ contact alternate fold lines 3*b* of the web portion in the duct 5 and ensure the formation of a stack wherein the panels 3*a* accurately overlap each other. As can be seen in FIG. 3, these portions of the lowermost panels 3*a* above the convex top face 11 are located at levels beneath the median portions of such panels; however, the panels which are immediately or closely adjacent the passages 20, 21 are at least substantially horizontal. This is attributable to the provision of the convex top face 11.

When the stack 6 in the duct 5 between the bottom wall 10 and the level of the tool 15 contains a preselected number of panels 3*a* (a corresponding signal can be generated and transmitted to the controls for the cylinder and piston unit 19 by a conventional counter in the machine which supplies the web 3, such as the aforementioned form printing machine), the cylinder and piston unit 19 causes the tool 15 to perform a forward stroke whereby the dull leading edge 18 enters the duct 5 by way of the passage 21, advances across the space between the sidewalls 7, 7′ of the duct and enters the passage 20 after having destroyed the fold line 3*b* at the aforementioned predetermined level (of the tool 15). The unit 19 can be designed to abruptly propel the tool 15 from the retracted position 15 to the extended position 15′.

The tool 15 thereupon remains in the extended position 15′ while the bottom wall 10 descends to its lower end position to thereby transfer the fully grown and freshly separated stack 6 onto the upper reach of the conveyor 16 which removes the fully grown stack from the combined stacking and separating station and advances it toward or all the way into the next-following machine, such as a packing or wrapping machine. The elevator including the motor M2 then rapidly lifts the bottom wall 10 to the upper end position in which the convex top face 11 is located immediately or closely below the tool 15. In the next step, the tool 15 is retracted so that the growing stack whose panels 3*a* were supported by the upper side of the tool 15 (in the extended position 15′ of such tool) descends and its lowermost panel 3*a* comes to rest on the top face 11. Jets or streamlets of air which issue from the orifices 17 in the upper side of the tool 15 form a cushion of air between the tool and the lowermost panel 3*a* of the growing stack so that the tool does not deface, shift and/or otherwise adversely influence the lowermost panel of the growing stack.

The operation is then repeated in the aforedescribed manner, i.e., the bottom wall 10 descends and the fully grown stack 6 on such bottom wall is separated from the lowermost panel 3*a* of the remaining portion of the advancing web 3 in response to renewed movement of the tool 15 from the retracted position to the extended position 15′.

Figure 4:
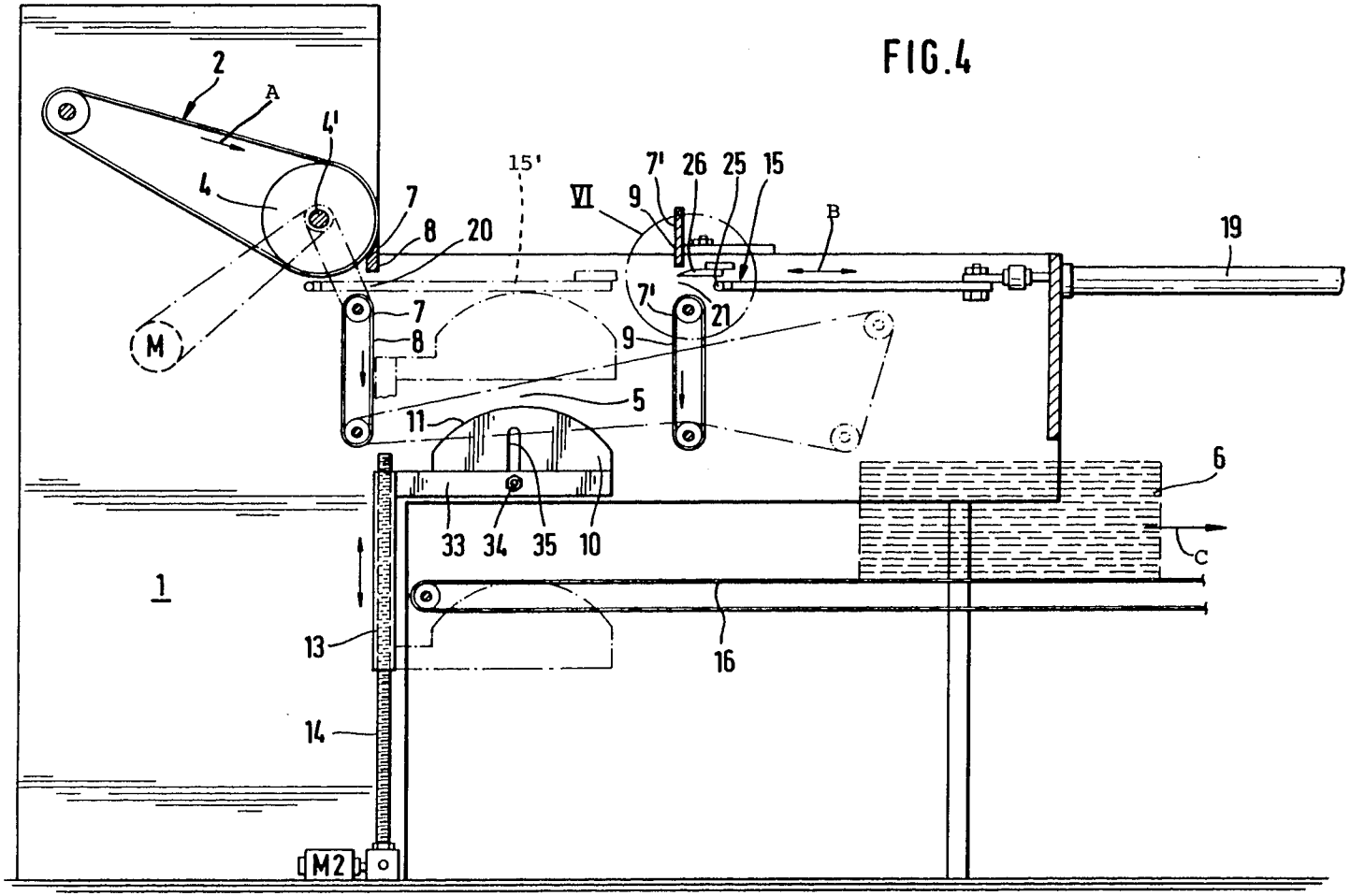
FIG. 4 is a partly elevational and partly vertical sectional view of a second apparatus wherein the leading edge of the severing tool is defined by a roller-shaped rotary element.
Figure 5:
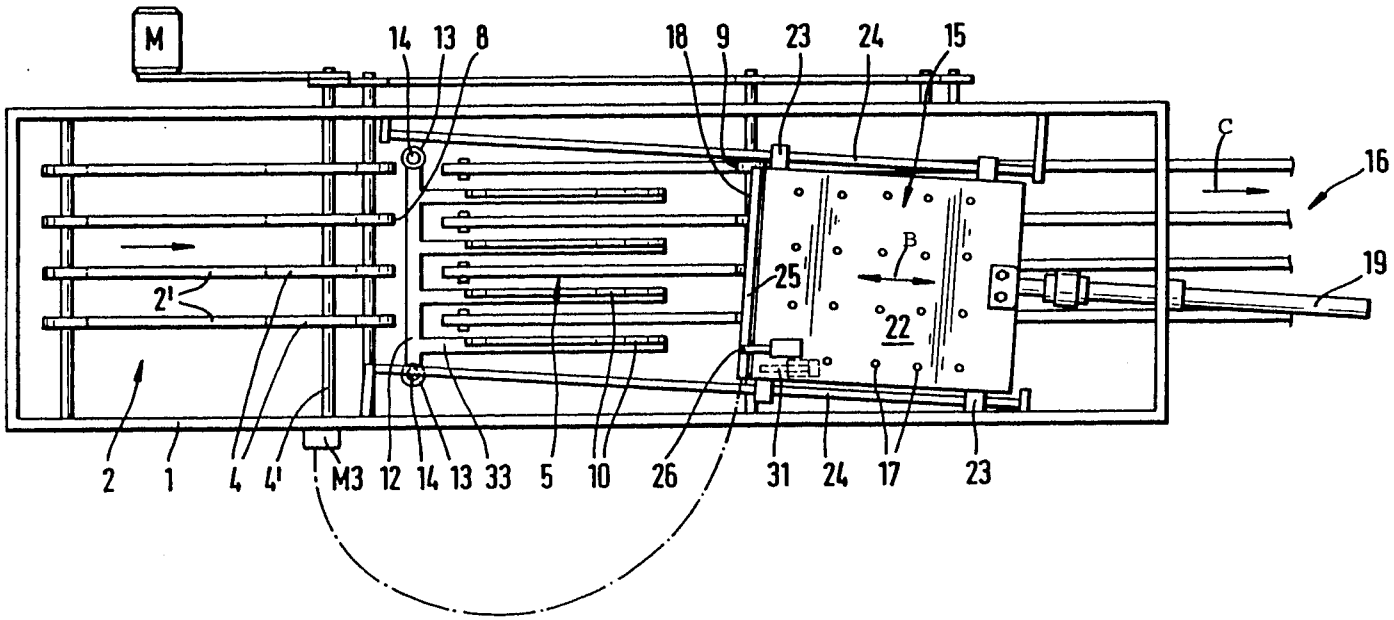
FIG. 5 is a plan view of the second apparatus.
Figure 6:
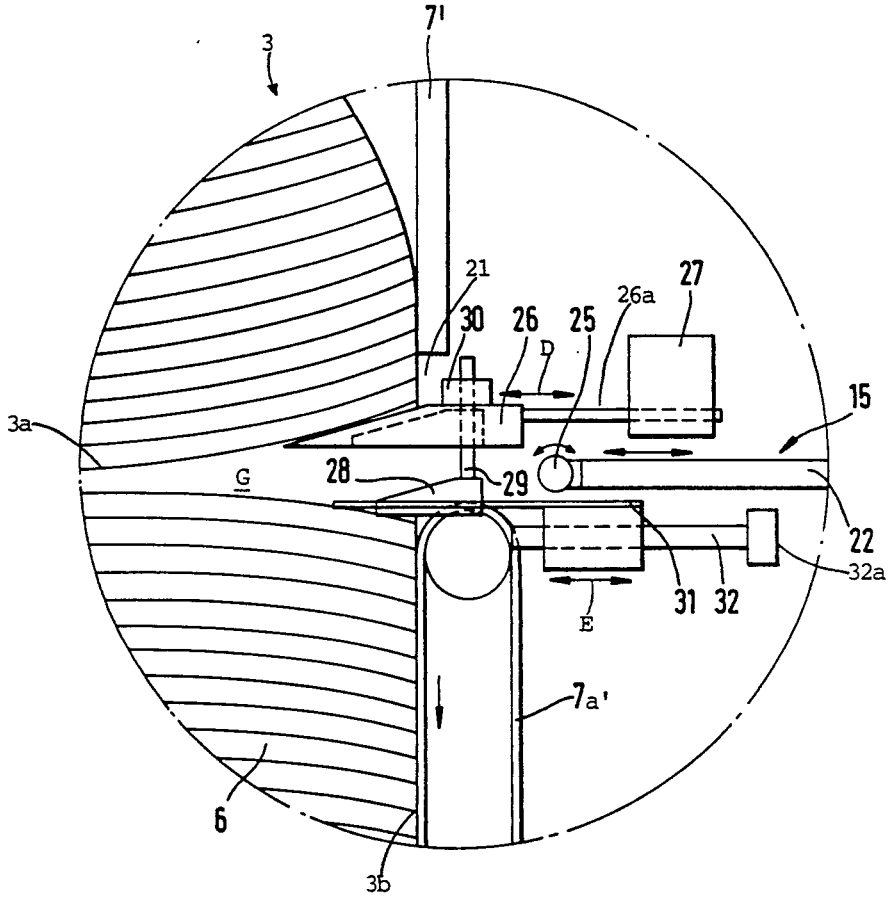
FIG. 6 is an enlarged view of a detail within the circle VI in FIG. 4.

FIGS. 4 to 6 show a modified apparatus wherein all such parts which are identical with or clearly analogous to the corresponding parts of the apparatus of FIGS. 1 to 3 are denoted by similar reference characters. The severing tool 15 comprises a flat hollow plate 22 with a dull leading edge 18 which is defined by an elongated small-diameter rotary element 25 (hereinafter called roller for short) which can be driven by a reversible electric or other suitable motor M3 so that it rotates in a clockwise or counterclockwise direction, depending upon the direction of movement of the tool 15 under the action of the cylinder and piston unit 19. The internal space of the plate 22 constitutes a plenum chamber which is connected to a source of compressed air and discharges jets or streamlets of compressed air via orifices 17 which are provided at least in the upper side of the tool 15. The marginal portions of the plate 22 are provided with pairs of aligned bearings 23 which are slidable along parallel horizontal tie rods 24 mounted in the frame 1. The direction of reciprocatory movement (arrow B) of the tool 15 in the apparatus of FIGS. 4–6 makes with the direction of the arrow A an acute angle, e.g., an angle of 5–30 degrees. This ensures that the axis of the roller 25 (which defines the dull leading edge 18) of the tool 15 is inclined relative to the surfaces 8, 9 and relative to the fold line 3*b* which is adjacent the surface 8 at the level of the plate 22 and is automatically destroyed in response to movement of the tool 15 to the extended position 15′. Destruction or breaking of a fold line 3*b* starting at one end and proceeding toward the other end is more predictable and necessitates the exertion of a smaller force than a breaking of severing by a leading edge all portions of which come into simultaneous contact with the adjacent portions of a fold line all the way from the one to the other end of the fold line.

The axis of the roller 25 extends, or can extend, at right angles to the axes of the tie rods 24. The operative connection between the reversible motor M3 and the roller 25 preferably includes a flexible shaft (not specifically shown) which enables the tool 15 to move along the horizontal path which is defined by the tie rods 24 while the roller 25 receives torque from the motor M3. The arrangement is such that the roller 25 is driven clockwise when the tool 15 advances toward the extended position 15′ so that the peripheral surface of the roller 25 rolls along the underside of the panel 3*a* immediately above the upper side of the plate 22, and that the roller 25 is driven in a counterclockwise direction when the unit 19 moves the tool 15 back to the retracted position, i.e., the roller 25 then again rolls along the underside of the panel 3*b* immediately above the plate of the plate 22. Such mode of rotating the roller 25 ensures that the tool 15 does not buckle, fold and/or otherwise adversely affect the lowermost panel 3*a* of the growing stack 6 above the plate 22 as well as that the roller 25 does not tend to extract the lowermost panel of the growing stack from the duct 5 by way of the slit-shaped passage 21 in the sidewall 7′.

Instead of employing a flexible shaft, the roller 25 can be driven by a rack and pinion drive, i.e., the roller 25 can be connected with a pinion which rolls along a stationary rack (extending in parallelism with the tie rods 24) when the unit 19 moves the tool 15 along the tie rods.

The apparatus of FIGS. 4 to 6 further comprises a spreading device which establishes a wedge-like gap G (FIG. 6) in front of the leading edge 18 (roller 25) of the tool 15 when the latter is caused to move from the retracted position toward the extended position. This ensures that the roller 25 does not strike any of the fold lines 3*b* adjacent the surface 9 but engages and breaks only that fold line 3*b* which is adjacent the surface 8 and is located at the level of the plate 22 while the tool 15 moves toward the extended position 15'. The spreading device comprises a wedge-like first component 26 having an extension **26*a* which is reciprocable (note the double-headed arrow D) in parallelism with the tool 15 by a pneumatic motor 27 mounted in or on the frame 1. The underside of the component 26 has a substantially wedge-like recess for a second component 28 of the spreading device. The component 28 is mounted at the lower end of a motion transmitting member 29 which can be moved up and down by a pneumatic motor or an electromagnet 30 on the component 26. FIG. 6 further shows a strip- or plate-like hold-down device 31 which is slidable in directions indicated by an arrow E (i.e., in parallelism with the tool 15 and component 26 of the spreading device) by a motion transmitting member 32 arranged to receive motion from a motor 32*a*** e.g., a pneumatic motor or an electromagnet.

In order to separate a fully grown stack 6 from the lowermost panel 3*b* of the remainder of the web 3, the motor 27 is actuated to cause the relatively sharp tip of the spreading component 26 to penetrate into the interior of the duct 5 by way of the passage 21 between the upper and lower portions of the sidewall 7'. The component 26 finds its way into the space between the adjacent panels 3*a* (namely between the topmost panel of the fully grown stack 6 resting on the top face 11 of the bottom wall 10 and the lowermost panel above the plane of the plate 22 forming part of the tool 15. At such time, the component 28 is still retracted into the recess at the underside of the component 26. In the next step, the motor 30 is started to expel the component 28 from the component 26 and to thus increase the width or height of the gap G in the region of the surface 9. The component 28 also serves to shift the panels 3*a* at the level of the passage 21 into the range of the inner stretch or reach of the belt 7*a'*, such stretch moves downwardly toward the bottom wall 10 and entrains the panels 3*a* in the same direction so as to increase the width of the right-hand portion of the gap G for more convenient entry of the roller 25 when the tool 15 begins to perform its forward stroke.

The next stage of operation involves introduction of the hold-down device 31 into the gap G so that the device 31 prevents the topmost panel 3*a* of the fully grown stack 6 on the bottom wall 10 from rising when the motor 30 retracts the component 28 into the recess of the component 26 so as to clear the path for advancement of the roller 25 into the gap G and across the entire duct 5 in order to break the fold line 3*b* which is then adjacent the surface 8 at the level of the plate 22. The bottom wall 10 can continue to descend during introduction of the component 26 into the duct 5 and also during subsequent introduction of the hold-down device 31 and retraction of the component 28 back into the recess of the component 26. In other words, the fully grown stack 6 can continue to descend, preferably gradually at a relatively low speed, while the spreading means including the components 26, 28 and the hold-down device 31 are in the process of establishing optimum conditions for introduction of the roller 25 into the duct 5. The roller 25 is driven in a clockwise direction (as seen in FIGS. 4 and 6) during penetration of the tool 15 into the duct 5 by way of the passage 21 in the guide 7'. Thus, the peripheral surface of the roller 25 rolls along the underside of the panel 3*a* immediately above the plate 22. At the same time, the orifices 17 discharge jets of compressed air to provide a cushion of air which prevents any undesirable shifting of the lowermost panel 3*a* of the freshly growing stack on top of the tool 15. If the spreading device including the components 26, 28 is not in the path of movement of the roller 25 into the duct 5, the component 28 can be retracted into the recess at the underside of the component 26, and the component 26 can be extracted from the gap G, while the tool 15 is in the process of performing a forward stroke toward the extended position 15'.

The tool 15 is moved back to the retracted position when the bottom wall 10 has completed the transfer of the freshly separated fully grown stack 6 onto the conveyor 16 and the elevator means including the motor M2 has returned the bottom wall 10 to the upper end position immediately or closely beneath the plate 22. At such time, the motor M3 rotates the roller 25 in a counterclockwise direction (as seen in FIGS. 4 and 6) so that the peripheral surface of the roller 25 again rolls along the underside of the panel 3*a* resting on the air cushion above the plate 22. This ensures that friction between the tool 15 and the panel 3*a* above it is minimal or negligible while the tool moves back toward the retracted position. Therefore, the tool cannot draw the panel immediately above it into and through the passage 21 in the sidewall 7'.

FIGS. 4 and 5 show carriers 33 which are movable up and down by at least one of the internally threaded sleeves 13 of the elevator means for the bottom wall 10. The carriers 33 support screws or another suitable threaded or unthreaded fasteners 34 which extend through elongated vertical slots 35 of the adjacent plates forming part of the composite bottom wall 10. Each plate of the bottom wall 10 is or can be mounted in the same way (see FIG. 5) so that the bottom wall 10 can be shifted relative to the carriers 33, i.e., the top face 11 of the bottom wall 10 can project above the carriers 33 to a desired extent. This enables the top face 11 to impart to the underside of the lowermost panel 3*a* of the stack 6 on the bottom wall 10 a more or less pronounced concave shape. This is desirable if the apparatus is to assemble stacks 6 from relatively stiff or from more readibly flexible panels. The adjustability of the level of the apex of the top face 11 relative to the carriers 33 renders it possible to select the level of the top face 11 relative to the carriers 33 in such a way that the topmost panel of a fully grown stack 6 on the bottom wall 10 is invariably located in or close to a horizontal plane to thus ensure predictable penetration of the spreading device 26, 28, of the hold-down device 31, and thereupon of the roller 25 into the duct 5.

A similar result can be achieved by employing an otherwise deformable bottom wall which can have the configuration (particularly the curvature) of its top face 11 altered so as to ensure that the panel or panels 3*a* at the level of the plate 22 will be at least substantially horizontal, at least at the time when the bottom wall 10 supports a fully grown stack.

The aforementioned friction reducing means including the orifices 17 in the upper side of the panel 22 can be replaced by, or used jointly with, other suitable friction reducing means. For example, the plate 22 of the tool 15 can carry a set of spherical, barrel-shaped and/or cylindrical rolling elements which engage the underside of the panel 3*a* immediately above the plate 22 when the tool 15 moves from the retracted to the extended position or in the opposite direction.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for subdividing a continuous web of mutually inclined panels in zig-zag formation wherein neighboring panels are connected to one another by fold lines, comprising a substantially upright duct including two spaced-apart sidewalls having confronting substantially vertical surfaces and a bottom wall; conveyor means for advancing the web longitudinally toward the duct while the neighboring panels of the advancing web at least partially overlap each other; means for directing successive panels of the advancing web into said duct so that the foremost panel of the web rests on said bottom wall and successive fold lines abut the surfaces of different sidewalls of the duct whereby the latter accumulates a growing stack of overlapping panels; and means for severing the web between two neighboring panels in said duct at a predetermined level between said directing means and said bottom wall by destroying a fold line which is located at said level adjacent one of said surfaces and connects the topmost panel of the stack between said bottom wall and said level with the panel above said level, including a flat severing tool having a dull leading edge, said tool including a substantially roller-shaped rotary element which defines said leading edge, said roller-shaped rotary element ensuring that the tool does not buckle, fold, and/or otherwise adversely affect the two neighboring panels at the predetermined level and means for moving said tool between a retracted position in which the tool is outside said duct and the leading edge is outwardly adjacent the other of said surfaces, along a substantially horizontal path extending across said duct at said level so that the leading edge destroys the fold line at said level to thereby separate the stacks between said bottom wall and said level from the panel above said level, and an extended position in which said leading edge is outwardly adjacent said one surface.

2. The apparatus of claim 1, wherein the sidewall having said one surface is provided with a substantially slit-shaped passage for said severing tool.

3. The apparatus of claim 1, wherein said conveyor means is arranged to advance the web in a predetermined direction, said bottom wall having a substantially convex panel-supporting top face with an apex extending substantially at right angles to said predetermined direction.

4. The apparatus of claim 1, wherein at least one of said sidewalls comprises an endless band having a substantially vertical stretch which is provided with the respective surface, and means for driving said belt so that said stretch advances toward said bottom wall.

5. The apparatus of claim 1, further comprising means for movably supporting at least one of said sidewalls so that said one sidewall is movable toward and away from the other of said sidewalls to thereby vary the distance between said surfaces.

6. The apparatus of claim 1, further comprising elevator means for moving said bottom wall upwardly toward but short of said level and downwardly to a predetermined second level, and second conveyor means arranged to accept a freshly separated stack from said bottom wall while said bottom wall descends toward said second level.

7. The apparatus of claim 1, wherein said conveyor means is arranged to advance the web in a predetermined direction, said bottom wall having a substantially convex panel-supporting top face with an apex extending substantially at right angles to said predetermined direction, said bottom wall being deformable so as to permit alterations of said top face.

8. The apparatus of claim 1, further comprising means for rotating said rotary element during movement of said tool along said path so that the rotary element rolls along the panel above said level while the tool moves toward said extended position.

9. The apparatus of claim 1, further comprising means for rotating said rotary element during movement of said tool along said path so that the rotary element rolls along the panel above said level during movement of the tool toward said retracted position.

10. The apparatus of claim 1, wherein said tool has an upper side and an underside, said severing means further comprising means for reducing friction at least between the upper side of said tool and the adjacent panel in said duct while the tool moves between said positions thereof.

11. The apparatus of claim 1, wherein said conveyor means is arranged to advance the web in a predetermined direction and said tool is movable along said path in a second direction at an acute angle to said predetermined direction.

12. The apparatus of claim 1, further comprising means for spreading apart said two neighboring panels in said duct at said predetermined level so that such panels define a gap above the stack adjacent the fold line at said predetermined level, and means for moving the spreading means at said level into the duct ahead of the leading edge of the tool.

13. The apparatus of claim 12, wherein said spreading means includes a plurality of components and means for moving at least one of said components relative to another component so as to establish said gap by moving the panel above or below said level away from the panel below or above said level.

14. Apparatus for subdividing a continuous web of mutually inclined panels in zig-zag formation wherein neighboring panels are connected to one another by fold lines, comprising a substantially upright duct including two spaced-apart sidewalls having confronting substantially vertical surfaces and a bottom wall, at least one of said sidewalls comprising an endless band having a substantially vertical stretch which is provided with the respective surface, and means for driving said belt so that said stretch advances toward said bottom wall; conveyor means for advancing the web longitudinally toward the duct while the neighboring panels of the advancing web at least partially overlap each other; means for directing successive panels of the advancing web into said duct so that the foremost panel of the web rests on said bottom wall and successive fold lines abut the surfaces of different sidewalls of the duct whereby the latter accumulates a growing stack of overlapping panels; and means for severing the web between two neighboring panels in said duct at a predetermined level between said directing means and said bottom wall by destroying a fold line which is located at said level adjacent one of said surfaces and connects the topmost panel of the stack between said bottom wall and said level with the panel above said level, including a flat severing tool having a dull leading edge, said tool including a substantially roller-shaped rotary element which defines said leading edge, said roller shaped rotary element ensuring that the tool does not buckle, fold, and/or otherwise adversely affect the two neighboring panels at the predetermined level and means for moving said tool between a retracted position in which the tool is outside said duct and the leading edge is outwardly adjacent the other of said surfaces, along a substantially horizontal path extending across said duct at said level so that the leading edge destroys the fold line at said level to thereby separate the stack between said bottom wall and said level from the panel above said level, and an extended position in which said leading edge is outwardly adjacent said one surface.

* * * * *